United States Patent [19]

Johnson

[11] 4,442,047

[45] Apr. 10, 1984

[54] MULTI-NOZZLE SPRAY DESUPERHEATER

[75] Inventor: Roger E. Johnson, Girard, Pa.

[73] Assignee: White Consolidated Industries, Inc., Cleveland, Ohio

[21] Appl. No.: 433,505

[22] Filed: Oct. 8, 1982

[51] Int. Cl.[3] ..... B01F 3/04

[52] U.S. Cl. ..... 261/66; 261/116; 261/DIG. 13; 137/897; 239/563

[58] Field of Search ..... 261/DIG. 13, 116, 66; 239/563; 137/897

[56] References Cited

U.S. PATENT DOCUMENTS

| | | | |
|---|---|---|---|
| 43,598 | 7/1864 | Noyes . | |
| 538,993 | 5/1895 | Winkler . | |
| 1,046,210 | 12/1912 | Meriam et al. | 137/897 |
| 1,062,614 | 5/1913 | Sneddon . | |
| 1,078,687 | 11/1913 | Lemale | 239/563 |
| 1,205,394 | 11/1916 | Roberts | 239/563 |
| 1,364,846 | 1/1921 | Shreve | 239/563 |
| 1,473,449 | 11/1923 | Stearns et al. . | |
| 1,578,313 | 3/1926 | Hencky . | |
| 1,604,779 | 10/1926 | McDermet . | |
| 1,662,452 | 3/1928 | Birks . | |
| 1,773,053 | 8/1930 | McDermet . | |
| 1,800,243 | 4/1931 | Birks et al. . | |
| 2,003,814 | 6/1935 | Taylor | 239/563 |
| 2,102,504 | 12/1937 | Beardsley, Jr. et al. | 261/39 |
| 2,155,986 | 4/1939 | Wheaton | 261/116 |
| 2,222,348 | 11/1940 | Gorrie | 122/479 |
| 2,254,472 | 9/1941 | Dahl | 251/29 |
| 2,355,458 | 8/1944 | Mastenbrook | 261/DIG. 13 |
| 2,687,614 | 8/1954 | Goddard | 60/39.77 |
| 2,725,221 | 11/1955 | Pontow . | |
| 2,945,685 | 7/1960 | Bowlus | 261/62 |
| 2,984,468 | 5/1961 | Kuhner | 261/79 |
| 3,034,771 | 5/1962 | Harris | 261/36 |
| 3,092,677 | 6/1963 | Spence | 261/16 |
| 3,134,827 | 5/1964 | Pontow et al. . | |
| 3,220,708 | 11/1965 | Matsui | 261/39 |
| 3,220,710 | 11/1965 | Forster | 261/69 |
| 3,287,001 | 11/1966 | Harris | 261/78 |
| 3,331,590 | 7/1967 | Battenfeld et al. | 261/50 |
| 3,719,524 | 3/1973 | Ripley et al. . | |
| 3,732,851 | 5/1973 | Self | 261/77 |
| 3,894,716 | 7/1975 | Barb | 251/127 |
| 3,904,722 | 9/1975 | Onoda et al. | 261/64 |
| 3,990,475 | 11/1976 | Myers | 137/625.3 |
| 4,011,287 | 3/1977 | Marley | 261/64 |
| 4,036,248 | 7/1977 | Yoshimori et al. | 137/271 |
| 4,130,611 | 12/1978 | Brand | 261/66 |
| 4,278,619 | 7/1981 | Tiefenthaler | 261/62 |

FOREIGN PATENT DOCUMENTS

| | | | |
|---|---|---|---|
| 124356 | 4/1931 | Austria | 266/115 |
| 1933800 | 1/1970 | Fed. Rep. of Germany | 137/897 |
| 50-6883 | 3/1975 | Japan . | |
| 11540 | of 1908 | United Kingdom . | |
| 1589530 | 5/1981 | United Kingdom . | |

*Primary Examiner*—Tim R. Miles

*Attorney, Agent, or Firm*—Felix L. D'Arienzo, Jr.

[57] ABSTRACT

A steam desuperheater comprising a liquid spray tube assembly positioned in a steam line and including a plurality of liquid outlet openings supplying liquid to plural spray nozzles, and a hollow piston plug axially movable therein upwardly from a lower valve seat to progressively open said outlet openings.

10 Claims, 11 Drawing Figures

MULTI-NOZZLE SPRAY DESUPERHEATER

BACKGROUND AND SUMMARY OF THE INVENTION

The present invention is directed to a multi-nozzle spray desuperheater. More particularly, the invention provides a new and improved spray tube assembly having a plurality of nozzle means whereby cooling water may be controllably injected into a fluid stream, typically steam, to selectively maintain the stream at a predetermined temperature level.

Generally, systems which depend upon steam in their operation are designed to operate with the stream at an optimum, predetermined temperature and pressure. In many instances, the steam being provided to the system is in a superheated condition and/or at a temperature considerably higher than is desirable for use in the utilization system. Typically, under such circumstances, a desuperheater is provided in the steam inlet line to cool and regulate the temperature of the incoming steam to the temperature level optimum for use in the system. Pursuant to a well known prior art proposal, the steam is cooled by the introduction of a spray of cooling water into the steam flow. In this manner, the water droplets of the cooling water spray mix with the steam flow thus removing heat from the steam and lowering its temperature. A common design for a prior art water spray type desuperheater provides for an adjustable valve with a discharge opening positioned in the steam line and arranged to inject a cooling water spray into the steam flow. Operation of the valve is regulated by a temperature sensor arranged to detect the temperature of the flowing stream at a point somewhat downstream from the position of the discharge opening of the adjustable valve. In many instances, the discharge opening of the valve is designed to inject the water in the form of a conical spray to insure a thorough mixing of the cooling water within and throughout the stream flow to thereby achieve a uniform temperature regulation.

In order for a water spray type desuperheater to be effective in an industrial scale steam utilization system, it is essential that the desuperheater device be operable to precisely control the amount of cooling water injected into the steam flow and to inject the cooling water in a spray form that will readily withdraw thermal energy from the steam. Moreover, the cooling water spray must follow a flow geometry whereby the cooling effects of the water flow are uniformly distributed throughout the steam flow. As should be understood, the inability of a water spray type desuperheater to precisely control the amount and characteristics of the water sprayed into the steam will greatly detract from the effectiveness of the desuperheater as a means to precisely control the temperature of the steam. A failure to precisely control the amount of water injected will directly result in an imprecisely determinable temperature change for the steam. Likewise, a non-uniformly dispersed water injection or a water injection lacking the necessary mist characteristics to faciliate a rapid evaporation of the water will result in a poorly controlled and uneven temperature reduction within and throughout the steam flow. In addition, the inability of the water injection to efficiently evaporate into the steam flow will cause an accumulation of water to form on the steam pipe in the vicinity of the discharge nozzle. This accumulation of water will eventually evaporate in a non-uniform and uncontrolled heat exchange between the water and the steam flowing around the water accumulation.

Another important consideration in the design of water spray-type desuperheaters is rangeability. This refers to the range of operation of the desuperheater (expressed in flow capacity utilization from maximum flow when fully open to a minimum flow) during which the desuperheater control over the water flow permits an effective cooling of the steam. Typically, a valve tends to lose flow control in the very low end of its range of operation, as when the valve plug is displaced a small distance from the valve seat. Consequently, adjustable valve type desuperheaters tend to have a rangeability which is less than desirable in many practical desuperheater applications.

One prior art proposal, disclosed in U.S. Pat. No. 4,130,611, addressed the optimum operating characteristics for a water spray type desuperheater, discussed above. Pursuant to the disclosure of U.S. Pat. No. 4,130,611, the desuperheater includes a multi-nozzle spray tube positioned in a steamline to inject a plurality of cooling water sprays into the steam flow. An axially movable valve plug is arranged within the spray tube and is utilized to progressively and sequentially expose the several nozzle means to water flow. The valve plug comprises a generally solid, unbalanced valve plug member tightly received in a leak-tight relation within the spray tube. The solid valve plug member may interrupt water flow to the desuperheater spray tube by mating with a valve seat arranged in the upper portions of the spray tube. Each of the nozzle means is in fluid communication with the water flow path portions of the spray tube and the several nozzle means are positioned about the cylindrical surface of the spray tube in a predetermined array. As the valve plug is lowered away from the valve seat and into the spray tube, the valve plug will sequentially and progressively expose the various nozzle means to fluid flow. Moreover, each of the nozzle means communicates with the water flow path portions of the spray tube through a plurality of small ports. Accordingly, the amount of water flowing into each of the nozzle means will gradually increase as the valve plug passes by the particular nozzle means and gradually uncovers the several port openings interconnecting the particular nozzle means with the water flow path portions of the spray tube. In this manner, the proposal of U.S. Pat. No. 4,130,611 provides a means to accurately control the total amount of water injected into the steam flow. In addition, each of the nozzle means is arranged and configured to impart a spiral motion to the water whereby the water injected by each of the nozzle means into the steam flow will be in the form of a swirling spray traveling along an expanding helical path to achieve a thorough and uniform mixing of the water and steam and to facilitate a controlled heat exchange between the cooling water and the superheated steam.

It is a primary objective of the present invention to provide a new and improved multi-nozzle, water spray type desuperheater including features affording a higher degree of controllability over the cooling water throughout a greater range of operation than has been possible with heretofore known desuperheater designs. Generally, the desuperheater of the present invention comprises a head assembly and a spray tube assembly. The head assembly is designed to mount the automatic control means for the desuperheater and includes integral mounting and cooling medium flanges to mount the spray tube assembly to a main steamline and to provide fluid communication between the spray tube assembly and a source of cooling water. The head assembly supports the spray tube assembly whereby the spray tube assembly extends into the steamline with the longitudinal axis of the spray tube assembly being perpendicular to the direction of flow of the steam and the nozzle means being located within the center of the steam flow. In this manner, the multiple nozzles of the spray tube assembly will be positioned to effectively inject cooling water into the steam flow, as will be fully discussed below.

Pursuant to an important feature of the invention, the spray tube assembly comprises a cage structure including an internal water flow path portion connected to the source of cooling water and a multiple nozzle plate subassembly mounted to the cage structure. A plurality of slot-like openings are formed in the cage structure wall to provide multiple fluid flow paths for flow communication between the internal water flow path portions of the cage structure and the several nozzle means of the multiple nozzle plate subassembly. A generally hollow cylindrical piston is arranged for controlled axial movement within the water flow path portions of the cage structure and is formed to be of a length sufficient to physically cover all of the slot-like openings when the piston is in its lowermost axial position. The piston is movable toward and away from a mating relation between the lower end edge of the piston and a valve seat formed at the lower end of the internal water flow path portions. The valve plug forming piston is formed to include several ports arranged at the top portions of the piston whereby the cooling water will flow from the source of water into and through the hollow valve plug toward the valve seat. The valve plug ports and resulting cooling water flow through the valve plug act to balance the valve plug whereby there are no water pressure effects acting upon the plug. This will assure highly controllable and accurate piston movement during the operation of the desuperheater.

Moreover, the piston is provided with sealing means so as to be in a generally leak-tight relation with the water flow path of the cage structure. This will prevent any water leakage between the exterior slot-covering portions of the piston and the internal wall portions of the water flow path. Significantly, the sealing means is arranged to permit some limited water flow around the outside of the piston in a volume defined by the sealing means and a clearance between the lowermost portions of the piston and the water flow path wall. When the piston is seated against the valve seat, the piston, valve seat and sealing means prevent any water flow from occurring and the piston physically covers all of the slot-like openings.

In accordance with the invention, the several nozzle means are arranged in a predetermined array across the surface of the multiple nozzle plate subassembly with each of the nozzle means being in flow communication with a complementary slot opening of the cage structure such that cooling water may flow from the water flow path portions of the cage structure into the particular nozzle means. The several nozzle means and their complementary slot-like openings are arranged and configured whereby the nozzle means will be progressively and sequentially exposed to water flow as the piston is lifted off the valve seat and gradually, controllably moved upwardly within the water flow path portions of the cage structure. After the piston is lifted off the valve seat, a portion of the cooling water will undergo a flow reversal as the water flows from the interior of the piston, around the lower end edge of the hollow piston and up into the volume defined by the sealing means and the above-described clearance. The water flow within the clearance is then throttled by the sealing means across the first slot-like opening exposed to fluid flow by the upwardly moving piston. The water flow reversal, sealing means throttling effect contributes to the controllability of the water flow by the desuperheater as it flows from the piston and into the slot-like opening.

An important feature of the invention includes a critical spacing between the sealing means and the lowermost valve seat-engaging end of the valve plug piston. More specifically, the sealing means is arranged to overlie the lowermost slot-like opening associated with the first-to-be-opened nozzle means when the piston is seated against the valve seat. The amount of spacing between the sealing means and the lowermost end of the piston is fixed such that the lowermost slot-like opening is substantially exposed (e.g., approximately 50% exposed) to fluid flow in the clearance immediately upon the lifting of the piston from the valve seat, e.g., within the first sixteenth of an inch of piston displacement. In this manner, the first nozzle means will begin to operate at a substantial percentage of its flow capacity, e.g., at approximately 50% of flow capacity as soon as the piston is lifted from the valve seat. Typically, at 50% capacity, the nozzle water injection will be in a fine mist spray form rather than in the relatively large water droplet dribble form typical of low flow rate nozzle operation. Accordingly, the desuperheater will be effective to inject an efficient cooling spray from the instant the piston is lifted from the valve seat and prevent any water accumulation due to a dribble of relatively large water droplets. What is important is that the initial operation of the first-to-operate nozzle means be at a flow capacity sufficient to provide immediate mist discharge.

To advantage, the water flow reversal, sealing means throttling effect will occur with respect to each of the remaining slot-like openings as the particular opening is being uncovered by the upwardly moving piston. The remaining slots will initially be fully covered by the piston and each of the remaining nozzle means will commence operation from zero flow capacity. However, as will be fully described below, the nozzle means are arranged to be sequentially exposed to fluid flow from the lowermost nozzle means to the uppermost nozzle means such that any water droplets emitted by a nozzle during the initial period of operation will fall into the spray of a lower nozzle and be atomized thereby. Inasmuch as the first nozzle commences operation with a spray, no water droplets will be able to accumulate on the steam pipe. In this manner, the amount and flow characteristics of the cooling water injected into the steam flow may be precisely controlled in accordance with the axial position of the balanced piston for substantially the full working stroke of the piston from a minimal displacement from the valve seat to full open operation. The piston may be continuously modulated through its work stroke to uncover or cover some or all of the nozzle means whereby the amount of cooling water injected into the steam flow may be accurately, continuously controlled to regulate the temperature of the steam. The present invention therefore provides precise flow control throughout a maximum range of operation.

Each of the nozzle means is provided with a swirl inducing structure to induce a high velocity swirling motion to the cooling water prior to discharge by the nozzle means into the steam flow. The swirling intensifies the mechanical breakdown action of the discharge nozzle and produces a swirling cone-shaped mist within the steam flow. The fine mist characteristics of the cooling water injected into the steam flow insures a rapid absorption of the cooling medium by the steam and optimum desuperheater efficiency in uniformly and controllably reducing the temperature of the superheated steam. As an additional feature of the invention, the multiple nozzle plate subassembly mounts the various nozzle means across a flat rectangular surface whereby the various sprays emitted by each of the nozzle means will undergo a swirling interaction with one another to provide a narrow, cone-shaped pattern. Such a pattern will tend to keep the water particle injection near the center of the steamline, where fluid turbulence is the greatest. The precise number, size and location of each of the nozzle means, as well as the volume of each of the complementary slot-like openings, may be designed to accommodate various cooling medium flow requirements as dictated by the particular desuperheater application. As a general principle, the invention contemplates that the various nozzle means are arranged relative to one another such that the progressive, sequential exposure of the nozzle means to fluid flow by the action of the upwardly moving piston results in a modified equal percentage characteristic. In other words, the nozzle means will be uncovered by the piston to achieve a gradual continuous increase in cooling water flow over the entire working stroke of the piston.

Empirical testing of prototype models of the invention indicate that the novel design features disclosed herein provide a desuperheater having a range of operation of precisely controlled cooling water flow significantly greater than has been obtainable with heretofore available water spray-type desuperheaters. Indeed, the prototype models have proven to be operable to achieve efficient cooling of a steam flow over substantially the full working stroke of the piston. Moreover, the mist characteristics of the injected water spray enable the spray to efficiently cool a steam flow traveling at a relatively slow flow rate. This is due to the fact that the precise flow control, mist geometry and water particle size within the injected mist achieved by the desuperheater of the present invention result in efficient cooling despite the minimum flow turbulence typical in low flow rate steam flows. Thus, the present invention provides a desuperheater with a significantly expanded range of operation and which is effectively operable in a wide range of practical applications.

For a better understanding of the above and other features and advantages of the invention, reference should be made to the following detailed description of a preferred embodiment of the invention and to the accompanying drawings.

DETAILED DESCRIPTION OF A PREFERRED EMBODIMENT OF THE INVENTION

Figure 1:
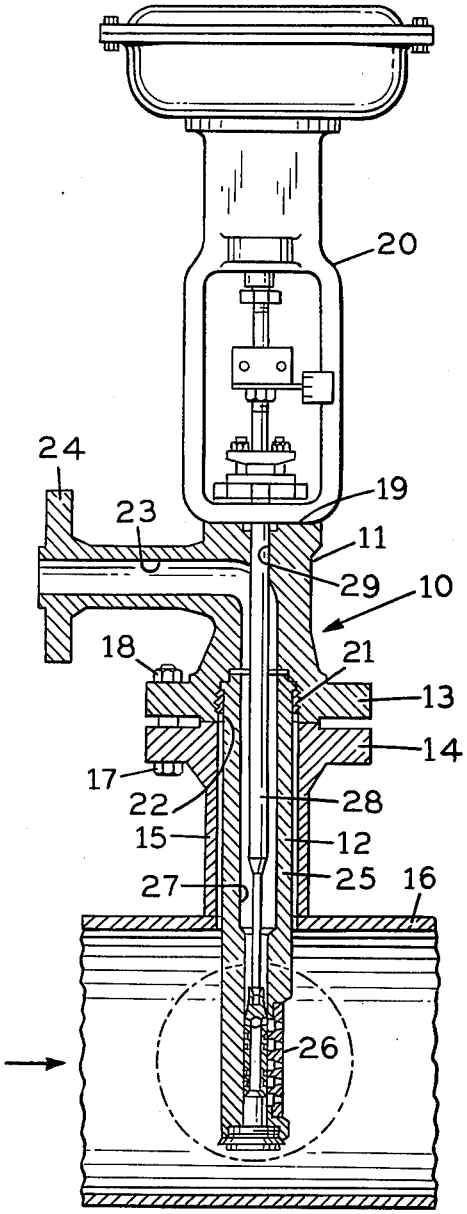
FIG. 1 is a side view, partially in cross section, of a multiple nozzle spray desuperheater built in accordance with the principles of the present invention.

Referring now to the drawings and initially to FIG. 1 thereof, there is illustrated a multiple nozzle spray desuperheater generally indicated by the reference numeral 10. The desuperheater comprises a head assembly 11 and a spray tube assembly 12. The head assembly 11 includes an integral mounting flange 13 for mounting the desuperheater 10 to a flange 14 of a desuperheater supporting structure 15 secured to a main steamline 16. To advantage, the flange 13 may be secured to the flange 14 by a plurality of nuts and bolts 17, 18. The head assembly 11 is also provided with a mounting boss 19 for mounting a diaphragm actuator 20, utilized to provide an automatic control for the desuperheater 10, as will be described. A threaded retaining ring 21 is secured around the upper portion of the spray tube assembly 12 whereby the spray tube assembly 12 is threadedly received and thereby secured within a mounting bore 22 formed in the head assembly 11. The bore 22 communicates with an elbow-shaped flow path 23 formed in the head asembly 11. The flow path 23 extends through the head assembly 11 to an integral cooling medium flange 24 which is connected to a source of cooling water in a well known manner (not specifically illustrated).

Pursuant to the invention, the spray tube assembly 12 comprises a generally hollow cylindrical cage structure 25 and a multiple nozzle plate subassembly 26. An internal fluid flow path portion 27 is formed to extend longitudinally throughout the full length of the cage structure 25. When the spray tube assembly 12 is mounted to the head assembly 11, the internal flow path portion 27 of the cage structure 25 is arranged to confront the lower end of the elbow-shaped flow path 23 to achieve fluid communication between the source of cooling water (not specifically illustrated) and the internal flow path portion 27 of the cage structure 25. A valve stem 28 is received in the internal flow path portion 27 and is arranged to extend through a bore 29 formed in the head assembly 11 to a mechanical connection with the diaphragm actuator 20. Accordingly, the valve stem 28 may be axially displaced by operation of the diaphragm actuator. Pursuant to well known prior art practice, the diaphragm actuator 20 is operatively associated with a temperature sensor (not specifically illustrated) arranged to detect the temperature of the steam flow flowing through the main steamline 16 at a point somewhat downstream from the desuperheater 10. When the temperature sensor detects a variation of the steam flow temperature above a predetermined optimum temperature level, the temperature sensor will operate to actuate the diaphragm actuator 20 whereby the valve stem 28 will be axially displaced in accordance with the magnitude of deviation from the predetermined optimum temperature level. As will be fully discussed below, the axial displacement of the valve stem 28 is utilized to control the amount of cooling water discharge by the desuperheater 10.

Figure 3:
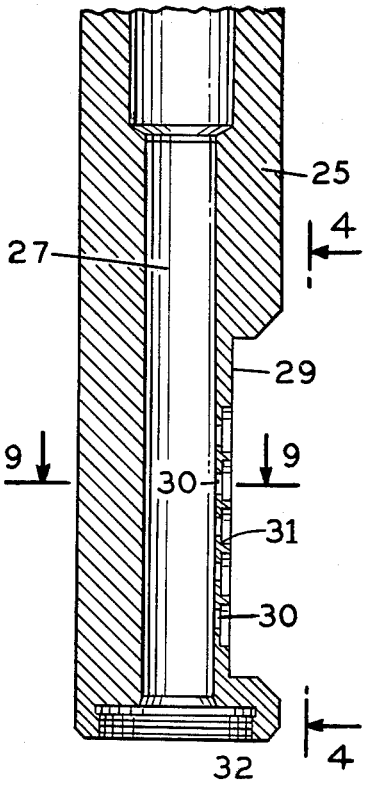
FIG. 3 is a side cross-sectional view of the lower end of the cage structure for a desuperheater built in accordance with the principles of the present invention.
Figure 4:
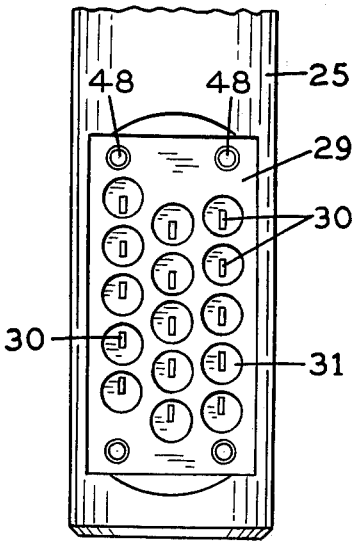
FIG. 4 is a front view of the cage structure illustrated in FIG. 3, and taken generally along line 4—4 of FIG. 3.

Referring now to FIGS. 3 and 4, a generally flat, rectangular recessed nozzle surface 29 is formed adjacent the lowermost end of the cage assembly 25. A plurality of generally slot-like openings 30 are formed through the rectangular surface 29. Each of the slot-like openings 30 opens to a relatively shallow cylindrical recess 31 arranged to partially support the multiple nozzle plate subassembly 26, as will appear. The cage structure 25 is formed to include an enlarged threaded cylindrical bore 32 communicating with the lowermost end of the internal flow path portion 27. An end plug member 33 (see FIG. 2) is threadedly received in the bore 32 to close off the end of the internal flow path portion 27. The end plug member 33 is provided with a sealing gasket 34 to insure a leak-tight sealing of the internal flow path portion 27. Moreover, the end plug member 33 is provided with an axially extending projection 35 having a diameter substantially equal to the internal diameter of the flow path portion 27 and including a tapered valve seat-forming top portion 36.

Pursuant to an important feature of the invention, the multiple nozzle plate subassembly 26 comprises a plurality of nozzle means 37 with each of the nozzle means 37 being associated with a complementary slot-like opening 30. As clearly illustrated in FIG. 2, each of the nozzle means comprises a hollow cylindrical spacer 38, a swirl disc 39, a discharge nozzle 40 and two sealing ring gaskets 41, 42. The spacer 38 of each of the nozzle means 37 is received in one of the circular recesses 31 of the rectangular surface 29 and all of the various components of each nozzle means 37 are held in compression against a complementary spacer 38 by a nozzle plate 43. The nozzle plate is formed to include a plurality of circular openings 44 spaced across the surface of the nozzle plate in a mirror image of the array followed by the circular recesses 31 formed in the rectangular surface 29 of the cage structure 25. Each of the circular openings 44 includes a step portion 45 whereby each of the nozzle means 37 will be received in one of the openings 44 of the nozzle plate 43 and be seated against the step portion 45 of the particular opening 44. The nozzle plate 43 is secured to the cage structure 25 by a series of bolts 46 which are received through openings 47 formed in the nozzle plate 43 and threadedly secured within openings 48 formed in the rectangular surface 29 of the cage structure 25.

To advantage, each of the swirl discs 39 is formed to include a plurality of beveled spokes 49 extending from a central hub **49*a* to an outer swirl disc ring 49*b*. As cooling water flows through the particular nozzle means 37, the beveled spokes 49 will induce a high velocity swirling motion in the water flow. Thereafter, the swirling water flow will pass into a water chamber 50 formed within the discharge nozzle 40 and out a discharge opening 51** as a swirling cone-shaped mist suitable to achieve a rapid evaporation of the water into the steam. In the preferred embodiment of the invention, a commercially available stainless steel Unijet® core is utilized.

In accordance with an important feature of the invention, precise control over fluid flow from the source of cooling water to the nozzle means 37 of the multiple nozzle plate subassembly 26 is achieved by a hollow valve plug-forming piston 52. The piston 52 is formed to include a lowermost end portion 53 including an inwardly tapered surface 54 arranged and configured to mate with the valve seat 36. The piston 52 is attached to the valve stem 28 at a tapered threaded junction 55 formed at the lowermost end of the valve stem 28. The piston 52 is locked to the stem 28 by a roll pin 56. In this manner, the piston 52 may be axially displaced by the valve stem 28 through a work stroke with the amount of displacement being a function of the magnitude of temperature change above an optimum temperature level as described above in the discussion of the operation of the diaphragm actuator 20. The valve stem 28 is arranged to seat the piston 52 against the valve seat 36 when the temperature sensor indicates that the temperature of the steam flow in steamline 16 is at the optimum temperature level.

Figure 2:
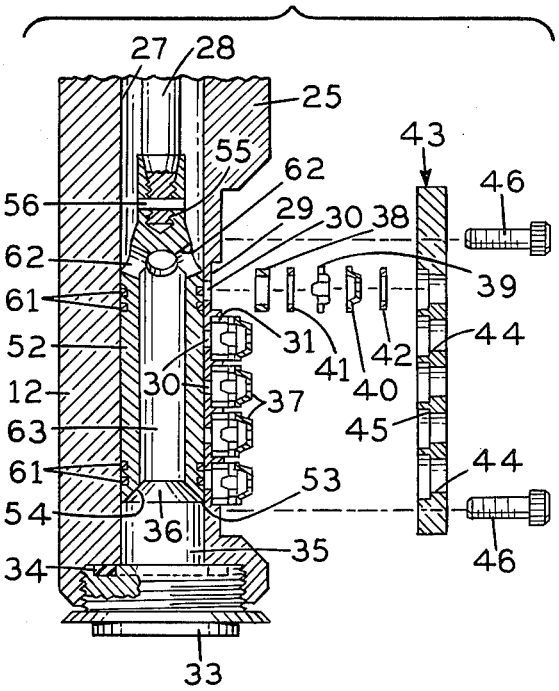
FIG. 2 is an exploded side cross-sectional view of the details of the lower nozzle end of the desuperheater illustrated in FIG. 1.
Figure 5:
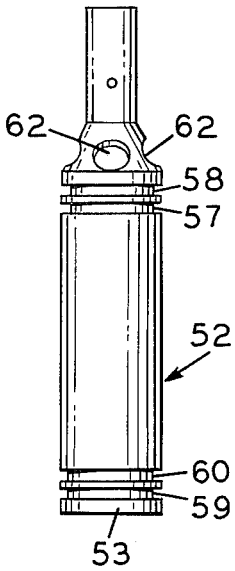
FIG. 5 is an elevational view of the valve plug-forming piston built in accordance with the principles of the present invention.
Figure 6:
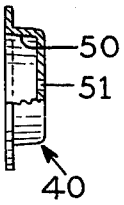
FIG. 6 is a side view, partially in cross section, of a typical nozzle disc of the desuperheater nozzle means.
Figure 7:
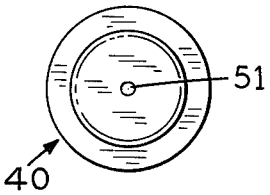
FIG. 7 is a front view of the nozzle means illustrated in FIG. 6.

When the piston 52 is seated against the valve seat 36, the piston 52 will physically cover all of the slot-like openings 30 (see FIG. 2). The piston 52 is formed to include a first pair of annular recesses 57, 58 arranged toward the uppermost portions of the piston 52 and a second pair of annular recesses 59, 60 arranged adjacent the lowermost end 53 of the piston 52. A series of four sealing piston rings 61 are arranged such that one of the piston sealing rings 61 is received in each of the annular recesses 57, 58, 59, 60 to provide a leak-tight relationship between the piston 52 and the surfaces of the internal flow path portion 27 of the cage structure 25. Furthermore, the piston 52 is formed to include a plurality of ports 62 formed above the annular recesses 57, 58 whereby cooling water flow within the internal flow path portion 27 may flow through the ports 62 into an internal flow chamber 63 defined by the hollow piston 52 and toward the valve seat 36. As should be understood, the seated piston 52 will isolate all of the slot-like openings 30 from fluid communication with the internal flow path portion 27. Accordingly, there will be no discharge of cooling water from the desuperheater 10 into the steam flowing in the steamline 16. Moreover, the piston rings 61 mounted in the annular recesses 57, 58 will insure that there is no leakage of water around the outside of the piston 52 and into the nozzle means 37. In the event the temperature sensor detects a rise in the temperature of the steam above the optimum temperature level, the sensor will actuate the diaphragm actuator 20 to lift the valve stem 28 causing the piston 52 to be displaced from the valve seat 36. The amount of displacement will be a function of the temperature variance detected by the temperature sensor.

Figure 8:
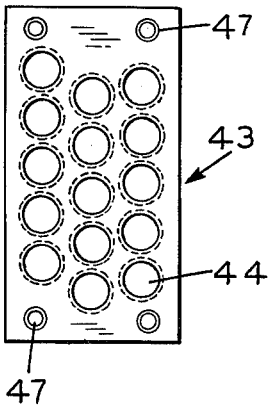
FIG. 8 is a front view of the nozzle plate component of the desuperheater multiple nozzle plate subassembly.
Figure 9:
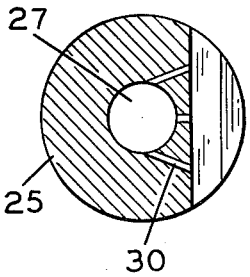
FIG. 9 is a top cross-sectional view of the cage structure taken generally along line 9—9 of FIG. 3.
Figure 10:
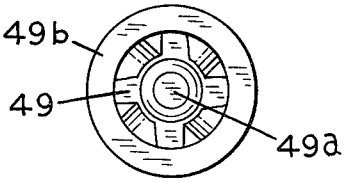
FIG. 10 is a front view of a typical swirl disc utilized in each of the nozzle means of the desuperheater according to the present invention.

As is clearly illustrated in FIG. 1, the head assembly 11 and spray tube assembly 12 are arranged relative to the desuperheater support structure 15 whereby the multiple nozzle plate subassembly 26 is positioned within the center of steam flow through the main steamline 16. Furthermore, the slot-like openings 30 and nozzle means 37 are arranged across the surface of the nozzle surface 29 whereby the cone-shaped mist discharged by each nozzle means 37 will undergo a swirling interaction with the mist injection of any adjacent operating nozzle means 37. Referring to FIGS. 4, 8 and 9, the slot-like openings 30 are arranged relative to one another, and to the piston 52 such that the slot-like openings 30 are progressively and sequentially uncovered by upward displacement of the piston 52. In this manner, the number of nozzle means 37 exposed to fluid flow through the slot-like openings 30 and therefore the total amount of cooling water flow at any particular time will be a function of the axial position of the piston 52. To advantage, the preferred embodiment spaces the slot-like openings 30 from one another so that there will be some overlap between adjacent openings 30 whereby the piston 52 will begin to uncover each opening 30 before the previous opening 30 is fully uncovered. This arrangement provides a smooth, gradual and continuous flow change with piston movemet.

In the operation of the desuperheater, once the piston 52 has been displaced from the valve seat 36, water may flow from the chamber 63 and out the lower open end of the piston 52 defined by the surface 54. A portion of the water flow will undergo a flow reversal as it flows around the lowermost end 53 of the piston 52 and ino a critical clearance arranged between the piston 52 and the internal walls of the flow path portion 27. Each of the internal flow path portion 27 of the cage structure 25 and the piston 52 are formed whereby there will be a generally snug fit between the piston 52 and the internal walls of the internal flow path portion 27. However, pursuant to standard manufacturing procedures, there will be some minimal clearance between the piston 52 and the wall surfaces of the internal flow path portions 27 (see FIG. 11). pursuant to the teachings of the present invention, this clearance is critical in that it must be sufficient to accommodate some fluid flow around the lower end 53 of the piston 52 and up toward the piston sealing ring 61 mounted in the annular recess 59. For example, in a prototype model of the preferred embodiment, the internal diameter of the internal flow path portion 27 is formed to be 1.000 inch with a tolerance of +0.002", −0.000". The piston is formed to have an outer diameter of 0.995 inches with a tolerance of +0.000", −0.002". Thus, there will be a clearance between the piston 52 and the internal walls of the flow path portion 27 of approximately 0.005 inches, + or − the acceptable tolerances for the individual components set forth above. It should be noted that all of the piston sealing rings 61 are arranged to prevent any general leakage around the outside of the piston 52, as discussed above.

Figure 11:
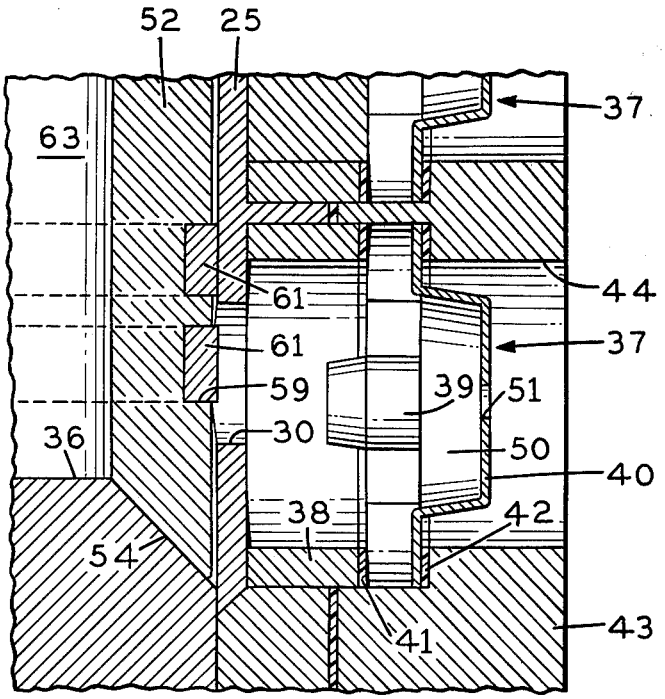
FIG. 11 is an enlarged, cross-sectional view of the lowermost end of the valve plug and the lowermost nozzle means of the desuperheater.

Referring now to FIGS. 2 and 11, it should be understood that any water flow in the above-described clearance may continue until it reaches the sealing piston 61 of the annular recess 59. This piston sealing ring 61 will prevent further upward water flow and at the same time serve as a throttline edge with respect to any particular one of the slot-like openings 30 upon which the lowermost sealing piston ring 61 overlies. The throttling edge effect of the lowermost sealing ring 61 will act to throttle water flow from the clearance into the particular slot-like opening as the particular nozzle means 37 is gradually exposed to water flow. The piston sealing ring 61 received in the annular recess 60 will prevent any by-pass leakage from the particular nozzle means 37 being exposed to the remaining covered nozzle means 37.

A second critical dimension contemplated by the present invention is the distance between the lowermost end of the piston ring 61 received in the annular recess 59 and the lowermost end 53 of the piston 52. As most clearly illustrated in FIG. 11, the lowermost sealing piston ring 61 is arranged to overlie the lowermost slot-like opening 30 associated with the first to be opened nozzle means 37 when the piston 52 is seated against the valve seat 36. In the preferred embodiment of the invention, the amount of spacing between the lowermost piston ring 61 and the lowermost end 53 of the piston 52 is fixed such that the lowermost slot-like opening 30 is approximately 50% exposed to fluid flow within the first sixteenth of an inch of displacement of the piston 52 from the valve seat 36. The prototype model embodying the invention was built whereby each of the openings 30 has a length of 0.25 inches and the spacing between the end 53 of the piston 52 and the bottom of the annular recess 59 is 0.152 inches. The extension 35 of the end plug member 33 is arranged to position the valve seat 36 whereby the 0.152 inch spacing places the lowermost piston ring 61 approximately one sixteenth of an inch above the bottom of the lowermost slot-like opening 30 when the piston 52 is seated against the valve seat 36. Accordingly, when the piston 52 is displaced one sixteenth of an inch from the valve seat 36 (which, for practical purposes, is considered to be a minimal displacement), the lowermost piston ring 61 will also be displaced one sixteenth of an inch whereby the lowermost piston ring 61 will now be one eighth of an inch above the bottom of the lowermost slot-like opening 30. Thus, the lowermost slot-like opening 30 is 50% exposed to fluid flow after minimal upward piston movement.

To advantage, the Unijet® swirl disc utilized in the nozzle means of the preferred embodiment of the invention is operable to provide a fine mist nozzle discharge when the nozzle is operating at 50% of flow capacity. Of course, the volume of the lowermost slot-like opening 30 is arranged relative to the dimensions of the flow as well as the flow capacity of the nozzle means such that the rate of flow through the 50% open slot is sufficient to achieve 50% flow capacity for the nozzle means 37. The critical dimensions discussed above therefore provide a desuperheater construction whereby the desuperheater commences operation with a highly efficient mist injection into the steam flow at a minimal displacement of the piston 52 from the valve seat 36. Thereafter, the amount of cooling water injected into the steam may be increased when necessary by a further upward displacement of the piston 52 to progressively and sequentially uncover additional nozzle means. Any relatively large water droplet discharge during the initial low capacity operation of any of the additional nozzle means 37 will fall due to gravity into the mist ejection of an adjacent lower operating nozzle means 37 and be atomized by the mist injection to be effective to provide additional efficient cooling of the steam.

Pursuant to the invention, the piston 52 may be continuously modulated by the operation of the diaphragm actuator 20 throughout its working stroke from minimal displacement from the valve seat to full open operation to provide a precisely controllable cooling water injection. The preferred nozzle means construction as well as the preferred arrangement for the several nozzle means will insure optimum efficiency in uniformly and controllably regulating the temperature of the steam flow while the highly advantageous piston, piston ring configuration taught by the present invention achieves a fine mist discharge over substantially the full working stroke of the piston 52, thereby obtaining uniformly excellent operating results over a maximum range of operation. The invention contemplates that the number of nozzle means may be varied with optimum results being achieved within the range of between 5 and 15 individual nozzle means. The size and location of each of the nozzle means relative to one another may also be varied depending upon the particular desuperheater application. For example, in some applications it may be advantageous for the nozzle means to have increasing capacity from the lowermost to the uppermost nozzle means. Most significantly, the actual operation of prototype models embodying the present invention have proven the practical utility of the features described above.

The above-described preferred embodiment of the invention is meant to be representative only, as certain changes may be made therein by persons skilled in the art without departing from the clear teachings of the invention. Accordingly, reference should be made to the following appended claims in determining the full scope of the invention.

I claim:

1. A desuperheater, which comprises (a) a cage structure including an internal flow path, (b) a generally flat, rectangular nozzle surface formed on said cage structure, (c) a plurality of slot-like openings formed through said cage structure and arranged in a predetermined pattern across the rectangular nozzle surface, (d) each of said slot-like openings providing flow communication between the internal flow path and the rectangular nozzle surface, (e) a plurality of nozzle means, (f) each of said nozzle means including a swirl inducing structure and a fluid discharge opening, (g) said nozzle means being arranged across and supported against said flat rectangular nozzle surface whereby each of said nozzle means is in flow communication with one of said slot-like openings, (h) a valve seat formed at the lowermost end of said internal flow path, and (i) a hollow piston plug received in a leak-tight relation within said internal flow path and arranged for selective, controlled axial displacement within said internal flow path through a predetermined work stroke, (j) said plug being matable with said valve seat when said plug is at the lowermost end of its work stroke, (k) said slot-like openings and said plug being arranged and configured whereby said plug physically covers and isolates all of said slot-like openings from flow communication with said internal flow path when said plug is seated against said valve seat, (l) said plug including at least one flow port formed at a topmost portion of the plug whereby fluid flow in said internal flow path will flow through said port into the interior of the hollow plug and toward said valve seat, (m) said plug including an opening formed at its lowermost end, (n) said slot-like openings and said plug being arranged and configured with respect to one another whereby said slot-like openings are progressively and sequentially exposed to flow communication with said internal flow path as said plug is axially displaced within said internal flow path toward the upper end of its work stroke.

2. The desuperheater according to claim 1, further characterized by each of said slot-like openings being of a rectangular solid configuration extending between said internal flow path and said generally flat, rectangular nozzle surface.

3. The desuperheater according to claim 1, further characterized by each of said nozzle means comprising a generally hollow, cylindrical spacer element, a swirl disc, and a discharge nozzle disc.

4. The desuperheater according to claim 3, further characterized by the spacer element, swirl disc and discharge nozzle disc of each of said nozzle means being held in compression against said generally flat, rectangular nozzle surface by a flat nozzle plate.

5. The desuperheater according to claim 4, further characterized by (a) said nozzle plate including a plurality of generally circular openings formed across the surface thereof and arranged whereby each of said openings overlies one of said nozzle means, (b) each of said openings including a step portion arranged to engage a portion of the nozzle means overlaid by said opening.

6. The desuperheater according to claim 1, further characterized by said slot-like openings being arranged and configured with respect to one another whereby the progressive and sequential exposure of the slot-like openings by the axial displacement of said plug occurs whereby the exposure of each slot-like opening by the valve plug will begin prior to the full exposure of the previous slot-like opening being exposed by said plug.

7. The desuperheater according to claim 1, further characterized by (a) a sealing means associated with said hollow piston plug to provide said leak-tight relation between said plug and the internal flow path, (b) said sealing means including at least one sealing piston ring arranged a predetermined distance above the lowermost end of the plug, (c) a predetermined clearance between said plug and said internal flow path whereby at least a portion of fluid flow from the interior of the hollow plug will undergo a flow reversal around the lowermost end of the plug into said clearance when said plug is displaced from said valve seat, (d) said piston ring being arranged and configured to prevent fluid flow in said clearance beyond the predetermined distance above the lowermost end of the plug and to define a throttling edge with respect to each of said slot-like openings during the progressive and sequential exposure of said slot-like openings whereby said throttling edge acts to throttle fluid flow in said clearance into the slot-like opening.

8. A desuperheater, which comprises (a) a cage structure including an internal flow path, (b) a plurality of nozzle means mounted on said cage structure and arranged across the surface thereof in a predetermined array, (c) each of said nozzle means being in flow communication with said internal flow path, (d) a valve seat formed at the lowermost end of said internal flow path, (e) a hollow piston plug received within said internal flow path and arranged for selective, controlled axial displacement within said internal flow path through a predetermined work stroke, (f) a sealing means associated with said hollow piston plug to provide a leak-tight relation between said plug and the internal flow path, (g) said sealing means including at least one sealing piston ring arranged a predetermined distance above the lowermost end of the plug, (h) said plug being matable with said valve seat when said plug is at the lowermost end of its work stroke, (i) said plug including at least one flow port formed at the topmost portion of the plug whereby fluid flow in said internal flow path will flow through said port into the interior of the hollow plug and toward said valve seat, (j) said plug including an opening formed at its lowermost end, (k) said nozzle means and said plug being arranged and configured with respect to one another whereby said nozzle means are progressively and sequentially exposed to flow communication with said internal flow path as said plug is axially displaced within said internal flow path away from said valve seat and toward the upper end of its work stroke, and (l) a predetermined clearance between said plug and said internal flow path whereby at least a portion of said fluid flow from the interior of the hollow plug will undergo a flow reversal around the lowermost end of the plug into said clearance when said plug is displaced from said valve seat, (m) said piston ring being arranged and configured to prevent fluid flow in said clearance beyond the predetermined distance above the lowermost end of the plug and to define a throttling edge with respect to each of said nozzle means during the progressive and sequential exposure of the nozzle means whereby said throttling edge acts to throttle fluid flow in said clearance into the nozzle means.

9. A desuperheater, which comprises (a) a cage structure including an internal flow path, (b) a plurality of nozzle means mounted on said cage structure and arranged across the surface thereof in a predetermined array, (c) a plurality of fluid flow openings formed through said cage structure and arranged to provide flow communication between said internal flow path and said nozzle means, (d) each of said nozzle means being associated with a complementary one of said fluid flow openings, (e) a valve seat formed within said internal flow path, (f) a valve plug received within said internal flow path and arranged for selective, controlled axial displacement within said internal flow path through a predetermined work stroke, (g) one end of said plug being matable with said valve seat when said plug is at one end of said work stroke whereby all of said fluid flow openings are isolated from flow communication with said internal flow path, (h) said fluid flow openings and said plug being arranged and configured with respect to one another whereby said fluid flow openings are progressively and sequentially exposed to flow communication with said internal flow path as said plug is axially displaced within said internal flow path away from said valve seat and toward the opposite end of said work stroke, (i) a sealing means associated with said valve plug to provide a leak-tight relation between said valve plug and the internal flow path, (j) said sealing means including at least one sealing piston ring arranged a predetermined distance from said one end of the plug, (k) said predetermined distance being fixed whereby said piston ring overlies the fluid flow opening associated with the first-to-be-opened nozzle means when said valve plug is seated against the valve seat, (l) a predetermined clearance between said plug and said internal flow path whereby at least a portion of fluid flow in said internal flow path may flow into said clearance after said plug is displaced from said valve seat, (m) said piston ring being arranged and configured to prevent fluid flow in said clerance beyond the predetermined distance from said one end of said plug and to define a throttling edge with respect to said last-mentioned fluid flow opening to throttle fluid flow in said clearance into said last-mentioned fluid flow opening, (n) each of said nozzle means including a swirl inducing structure and a fluid discharge opening whereby said nozzle means will discharge a fine mist water spray through said discharge opening when water flow through said nozzle means is above a certain percentage of the flow capacity of said nozzle means, (o) said predetermined distance arranged whereby the amount said piston ring overlies the fluid flow opening associated with the first-to-be-opened nozzle means is sufficient to accommodate an immediate fluid flow in said first-to-be-opened nozzle means above said certain percentage of flow capacity within a predetermined minimal displacement of said valve plug from said valve seat.

10. The desuperheater according to claim 9, further characterized by (a) said fluid flow openings being progressively and sequentially exposed to flow communication with said internal flow path by said valve plug from a lowermost fluid flow opening to an uppermost fluid flow opening, (b) said first-to-be-opened nozzle means being associated with said lowermost fluid flow opening.

* * * * *